US007121190B2

(12) United States Patent
Ogawa et al.

(10) Patent No.: US 7,121,190 B2
(45) Date of Patent: Oct. 17, 2006

(54) FLUID MACHINE FOR GAS COMPRESSION REFRIGERATING SYSTEM

(75) Inventors: Hiroshi Ogawa, Nagoya (JP); Mikio Matsuda, Okazaki (JP); Kazuhide Uchida, Hamamatsu (JP); Shigeki Iwanami, Okazaki (JP); Keiichi Uno, Kariya (JP); Hironori Asa, Okazaki (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 197 days.

(21) Appl. No.: 10/948,636

(22) Filed: Sep. 24, 2004

(65) Prior Publication Data

US 2005/0188713 A1 Sep. 1, 2005

(30) Foreign Application Priority Data

Sep. 26, 2003 (JP) ..... 2003-336115

(51) Int. Cl.
*F01B 13/04* (2006.01)

(52) U.S. Cl. ..... 92/12.2; 92/57; 92/71; 60/653; 60/671

(58) Field of Classification Search ..... 92/12.2, 92/57, 71; 60/651, 653, 671
See application file for complete search history.

(56) References Cited

U.S. PATENT DOCUMENTS 4,297,086 A * 10/1981 McGowan ..... 417/271
4,819,429 A * 4/1989 Kordak ..... 60/414
6,659,738 B1 * 12/2003 Iwanami et al. ..... 417/374
6,796,774 B1 * 9/2004 Stolzer ..... 417/269
2003/0010195 A1 * 1/2003 Stolzer ..... 91/486
2004/0184923 A1 * 9/2004 Iwanami et al. ..... 417/221

FOREIGN PATENT DOCUMENTS

JP B-2540738 7/1996

OTHER PUBLICATIONS

U.S. Appl. No. 10/764,534, filed Jan. 27, 2004, Iwanami et al., (corresp. to the JP-2003-165112 discussed on p. 3 of the specification).

* cited by examiner

*Primary Examiner*—Hoang Nguyen
(74) *Attorney, Agent, or Firm*—Posz Law Group, PLC

(57) ABSTRACT

A fluid machine for a gas compression refrigerating system comprises a first and a second working for performing a pump mode operation, in which working fluid of low pressure is sucked into and compressed by the working chambers. The fluid machine further comprises valve mechanism for selectively forming a motor mode passage in combination with a fluid passage change-over device, so that super heated working fluid of high pressure is introduced into at least one of the working chambers to perform a motor mode operation, in which the high pressure working fluid is expanded in the working chamber to obtain mechanical energy. The fluid machine according to the invention, therefore, performs the pump mode operation at one of the working chambers and at the same time the motor mode operation at the other working chamber.

13 Claims, 10 Drawing Sheets

FLUID MACHINE FOR GAS COMPRESSION REFRIGERATING SYSTEM

CROSS REFERENCE TO RELATED APPLICATION

This application is based on Japanese Patent Application No. 2003-336115 filed on Sep. 26, 2003, the disclosure of which is incorporated herein by reference.

FIELD OF THE INVENTION

This invention relates to a fluid machine having a function of a pump mode operation for compressing working fluid and a further function of a motor mode operation for converting fluid pressure into mechanical energy as kinetic energy, and more particularly to a compressor device integrated with an expansion device for gas compression refrigerating system having a waste heat collecting system, such as Rankine cycle for collecting heat energy.

BACKGROUND OF THE INVENTION

In a conventional gas compression refrigerating system having the Rankine cycle, a compressor device of the system is also used as an expansion device when heat energy is collected by the Rankine cycle, for example, as disclosed in Japanese Patent No. 2540738.

In the compressor device of this system, gas, such as gas-phase refrigerant is sucked into a working chamber and the gas is compressed in accordance with a decrease of the volume of the working chamber upon receiving an external mechanical energy, so that compressed refrigerant is pumped out from the compressor device. On the other hand, in the expansion device, high pressure gas is introduced into the working chamber to expand the volume of the working chamber by the pressure of the gas, so that the mechanical energy can be obtained. Accordingly, a flow direction of the gas, i.e. the refrigerant, needs to be reversed, when the function of the fluid machine is changed from the compressor device to the expansion device.

According to the prior art system, as disclosed in the above Japanese Patent, however, an inlet and discharge ports for the refrigerant for an operation as the expansion device are provided on the same side of an inlet and discharge ports for the refrigerant for an operation as the compressor device. And therefore, the compressor device can not be used as the expansion device, as a single mechanical device. As a result, either one of the Rankine cycle (gas expanding) operation and the gas compression operation can not be properly carried out.

More in detail, a check valve is generally provided at a discharge port of the compressor device for preventing the working fluid from flowing in the reversed direction from a high pressure chamber (a discharge chamber) to a working chamber, since the working fluid is compressed by decreasing the volume of the working chamber by moving mechanical movable parts, such as pistons, movable scrolls and so on, and the discharge port communicates the high pressure chamber with the working chamber.

On the other hand, the expansion device generates mechanical output by introducing the high pressure working fluid from the high pressure chamber into the working chamber to move the mechanical movable parts. And therefore, the high pressure working fluid can not be simply introduced from the high pressure chamber into the working chamber because of the check valve provided at the discharge port. As above, the compressor device cannot be used as the expansion device by simply changing over the inlet and discharge ports, to achieve the reversed flow of the working fluid.

In view of those problems, the applicant of this invention has proposed in its prior patent application (Japanese Patent Application No. 2003-165112, corresponding to U.S. patent application Ser. No. 10/764,534) a new fluid machine, in which a high pressure and a low pressure chambers as well as a valve mechanism are provided, so that a fluid flow from a working chamber to the low pressure chamber and another (reversed) fluid flow from the high pressure chamber to the working chamber can be realized in the respective operations as the compressor device and the expansion device. It is, however, disadvantageous in that the waste heat can be collected by the fluid machine (by operating it as the expansion device) only when gas compression operation (by operating it as the compressor device) is not necessary. If the compressor device and the expansion device were separately provided, then the fluid machine would become larger in its structure.

SUMMARY OF THE INVENTION

The present invention is made in view of the above problems, and it is an object of the present invention to provide a fluid machine, which can perform a pump mode operation and a motor mode operation at the same time, without providing a compressor device and an expansion device separately, wherein working fluid is compressed in the pump mode operation and mechanical energy is obtained by converting fluid pressure into kinetic energy in the motor mode operation.

According to one of the features of the present invention, a fluid machine for a gas compression refrigerating system comprises multiple (first and second) working chambers, each having a piston for moving in a reciprocal manner so that the volume of the working chamber is varied. When working fluid of low pressure is supplied to an inlet side of the fluid machine, and the pistons of the working chambers are driven by an outside source, for example, an internal combustion engine, the working chambers are operated in the pump mode operation to suck in the working fluid into the working chambers and to discharge a compressed high pressure working fluid to output side of the fluid machine. The gas compression refrigerating system comprises a fluid passage change-over device for changing fluid flows of the working fluid to and from the fluid machine. The fluid machine further comprises a low pressure chamber, a high pressure chamber and a valve mechanism, wherein the valve mechanism selectively forms a motor mode passage from the high pressure chamber to the low pressure chamber through at least one of the working chambers (the second working chamber). When super heated working fluid of high pressure is introduced into the high pressure chamber by the fluid passage change-over device, the second working chamber is operated in a motor mode operation to generate a mechanical energy.

As above, at least one of the working chambers can selectively perform either one of the pump mode and the motor mode operations. Accordingly, a fluid machine performing the pump mode and motor mode operations at the same time can be realized without separately providing a compressor device and an expansion device.

According to another feature of the present invention, the valve mechanism further selectively forms a motor mode passage from the high pressure chamber to the low pressure chamber through the other working chambers (the first working chamber). As a result, all of the working chambers can perform the motor mode operation, when the super heated working fluid of high pressure is introduced into the high pressure chamber, so that the mechanical energy can be obtained at most.

According to a further feature of the present invention, the valve mechanism comprises a valve member, which is synchronously operated with a rotation of a shaft of the fluid machine, so that the valve member controls the communication between the working chambers and the inlet and outlet side of the fluid machine, as well as the communication between the working chambers and the high pressure and low pressure chambers. With the arrangement of the valve member, the opening and closing of the working chambers are controlled synchronously with the rotation of the shaft and the reciprocal movement of the pistons.

BRIEF DESCRIPTION OF THE DRAWINGS

The above and other objects, features and advantages of the present invention will become more apparent from the following detailed description made with reference to the accompanying drawing. In the drawing.

DETAILED DESCRIPTION OF THE PREFERRED EMBODIMENTS

First Embodiment

Figure 1:
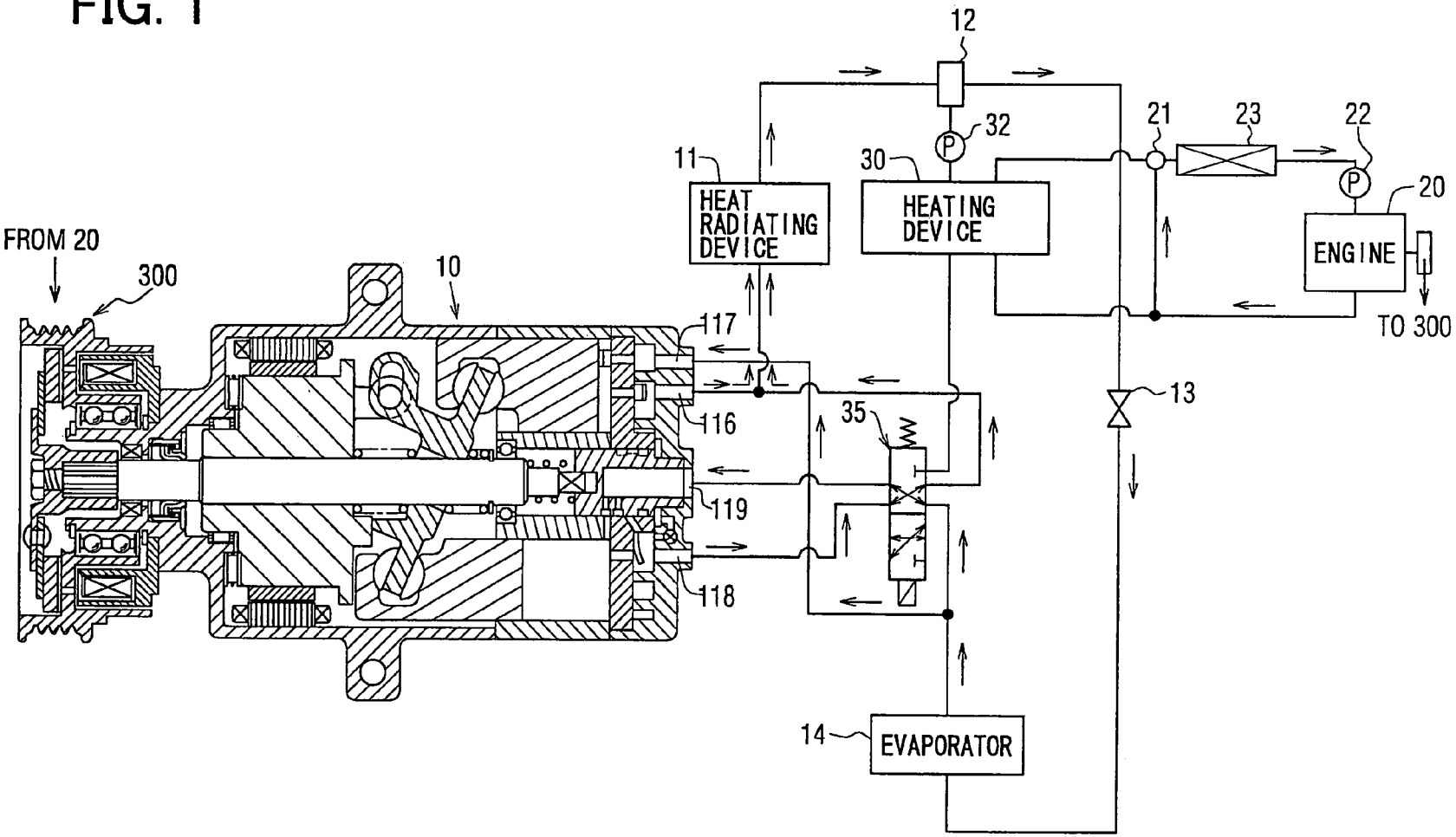
FIG. 1 is a schematic diagram showing a Rankine vapor compression refrigerating system according to a first embodiment of the present invention, wherein a flow of refrigerant is indicated in a pump mode operation.
Figure 2:
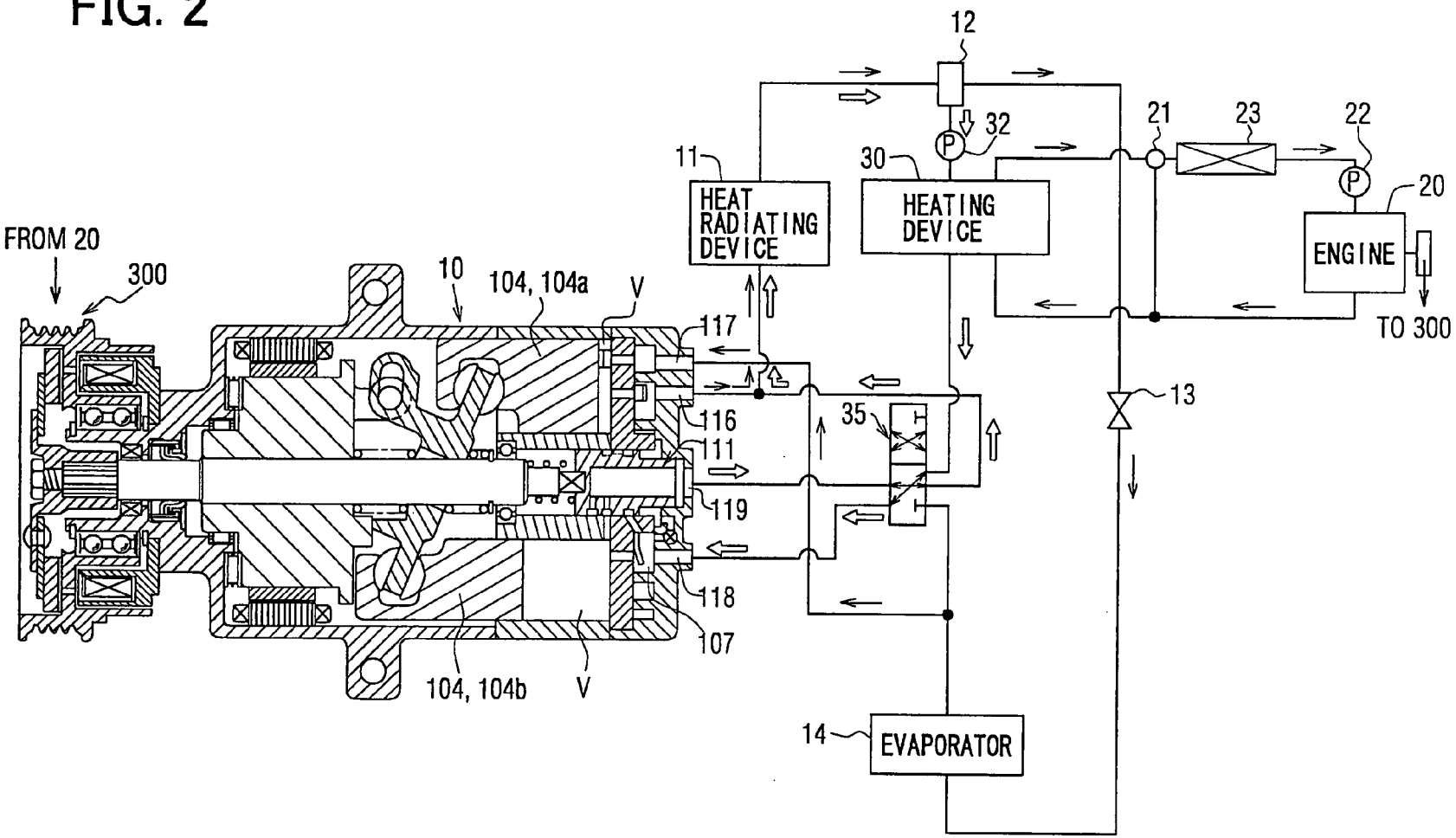
FIG. 2 is a schematic diagram of the Rankine vapor compression refrigerating system shown in FIG. 1, wherein a flow of the refrigerant is indicated in a pump-motor mode operation.

The first embodiment of the present invention relates to a fluid machine used in a vapor compression refrigerating system for a motor vehicle having Rankine cycle, wherein FIGS. 1 and 2 show schematic diagrams of the vapor compression refrigerating system.

The vapor compression refrigerating system according to this embodiment collects energy from waste heat generated at an internal combustion engine 20 generating a running force for a motor vehicle, and utilizes thermal energy generated and/or collected by a fluid machine for performing an air-conditioning operation for the motor vehicle. The gas compression refrigerating system having the Rankine cycle will be explained.

A fluid machine 10, which comprises a compressor device integrated with an expansion device, outputs mechanical energy in a motor mode operation by converting fluid pressure of super heated refrigerant into kinetic energy, in addition to a pump mode operation in which the fluid machine compresses gas-phase refrigerant and discharges a pressurized refrigerant. A heat exchanger 11 is a heat radiating device connected to a discharge port 116 of the fluid machine 10 (the compressor device with the expansion device, which will be also referred to as the compressor device, hereinafter) and for radiating heat from the refrigerant and cooling down the same. The detailed structure of the compressor device 10 will be explained hereinafter.

A gas-liquid separator 12 is a receiver for separating the refrigerant from the heat radiating device 11 into gas-phase and liquid-phase refrigerants. A depressurizing device 13 depressurizes and expands the liquid-phase refrigerant separated at the gas-liquid separator 12, wherein the refrigerant is depressurized in an isenthalpic manner in this embodiment and a thermal-type expansion valve is used here so that an opening degree of the valve is controlled to keep degree of super heat for the refrigerant to be sucked into the compressor device 10 at a predetermined value when the compressor device 10 is operated in the pump mode operation.

An evaporator 14 is a heat absorbing device for absorbing the heat from the ambient air by vaporizing the depressurized refrigerant from the expansion valve 13 (the depressurizing device) and is connected to an inlet port 117 of the compressor device 10.

A fluid passage change-over device 35 branches off from a downstream side of the evaporator 14, and the evaporator 14 is also connected to a low-pressure port 119 of the compressor device 10 through this fluid passage change-over device 35 with a change-over position shown in FIG. 1. A high-pressure port 118 of the compressor device 10 is also connected to the fluid passage change-over device 35 so that the high-pressure port 118 is connected to the heat radiating device 11 through the device 35.

As above, the gas compression refrigerating system for transferring the heat from a low temperature side to a high temperature side is composed of the fluid machine 10 (the compressor device integrated with the expansion device), the heat radiating device 11, the gas-liquid separator 12, the depressurizing device 13, the evaporator 14 and the fluid passage change-over device 35. The fluid passage change-over device 35 comprises an electromagnetic valve, an opening and/or closing position of which is controlled by an electronic control unit (not shown).

A heating device 30 is a heat exchanger for heating the refrigerant by heat-exchanging between the refrigerant flowing through a refrigerant circuit and an engine cooling water, wherein a three-way valve 21 controls the flow of the engine cooling water from the engine 20, so that the flow and non-flow of the cooling water through the heating device 30 is switched over. The three-way valve 21 is also controlled by the electronic control unit (not shown).

The heating device 30 is provided in a fluid passage branching off from the gas-liquid separator 12 and connected to the fluid passage change-over device 35. With the position of the fluid passage change-over device 35 shown in FIG. 2, a downstream side of the heating device 30 is connected to the high-pressure port 118 of the compressor device 10 through the fluid passage change-over device 35. The low-pressure port 119 of the compressor device 10 is connected to the heat radiating device 11 through the fluid passage change-over device 35 in FIG. 2. A liquid pump 32 is provided at an upstream side of the heating device 30 for circulating the refrigerant, wherein the liquid pump 32 comprises an electrically driven pump controlled by the electronic control unit (not shown).

The Rankine cycle is composed of the gas-liquid separator 12, the liquid pump 32, the heating device 30, the fluid passage change-over device 35, the compressor device 10 integrated with the expansion device and the heat radiating device 11, and collects the waste heat generated at the engine 20.

In FIGS. 1 and 2, a water pump 22 circulates the engine cooling water and a radiator 23 is an heat exchanger for cooling down the engine cooling water by heat-exchanging between the cooling water and the ambient air. In the drawings of FIGS. 1 and 2, a bypass passage for bypassing the radiator 23 and a flow-rate control valve for controlling the flow-rate of the cooling water flowing through the bypass passage and the radiator are omitted. Although the water pump 22 is a mechanical type pump driven by the engine 20 in the embodiment, an electrically driven pump can be also used for the water pump 22.

The fluid machine 10 of the compressor device integrated with the expansion device is explained with reference to FIGS. 3 to 8.

Figure 3:
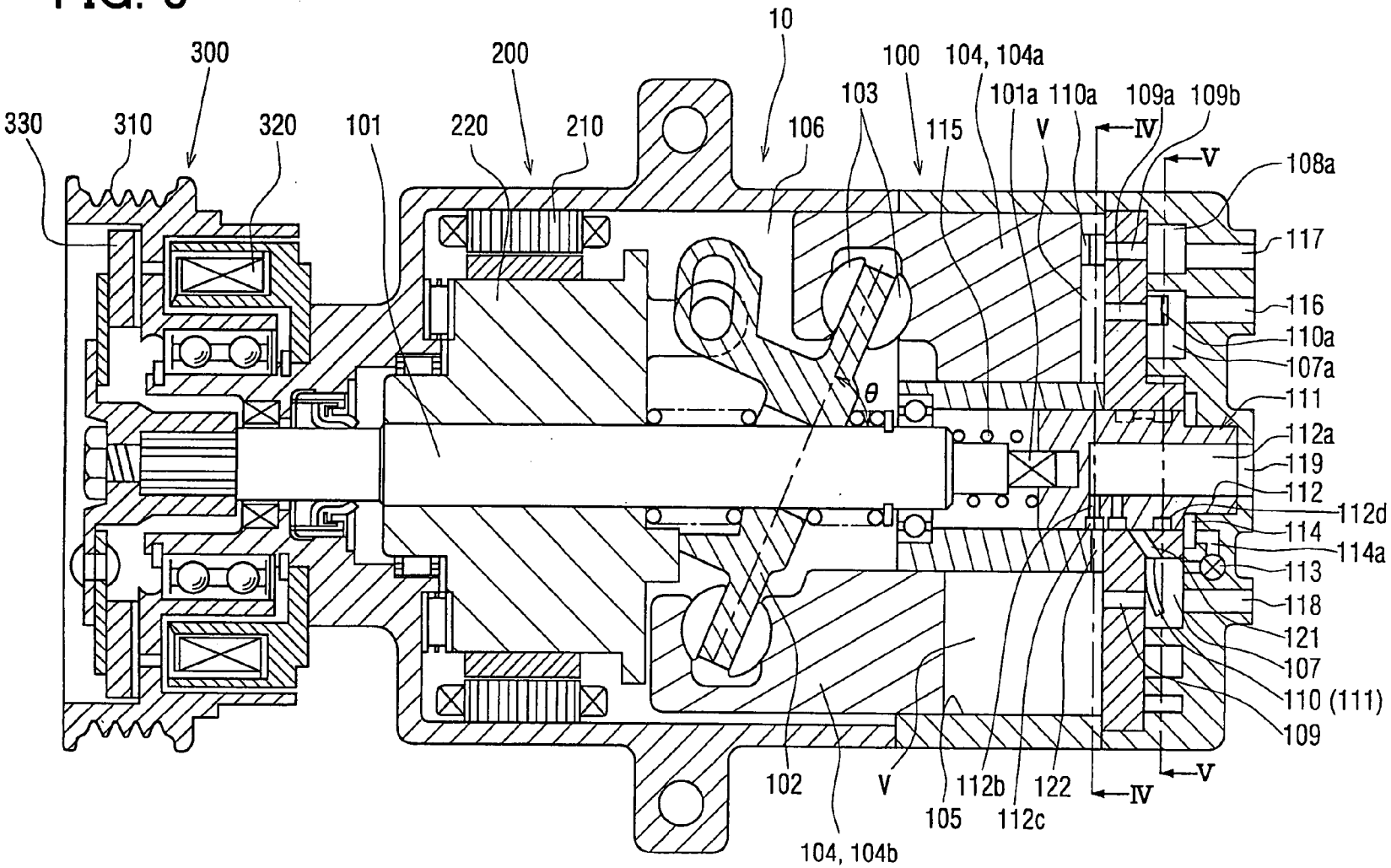
FIG. 3 is across sectional view of a fluid machine (a compressor device integrated with an expansion device) for the Rankine vapor compression system shown in FIG. 1, which is in the pump mode operation.
Figure 4:
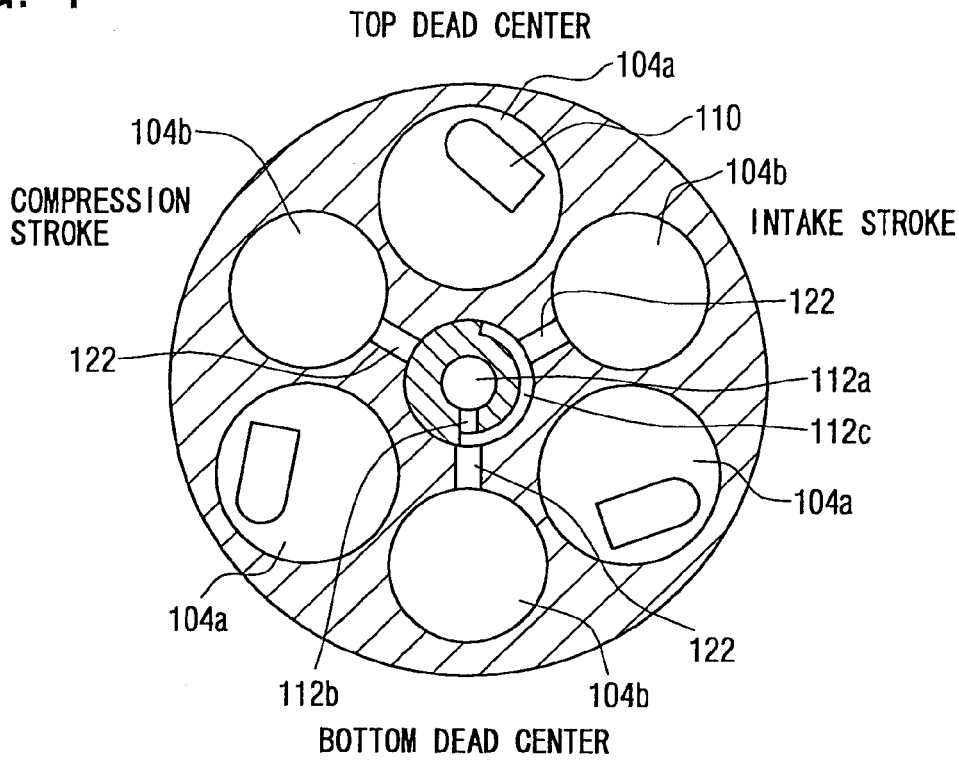
FIG. 4 is a cross sectional view of the fluid machine taken along a line IV—IV in FIG. 3.
Figure 5:
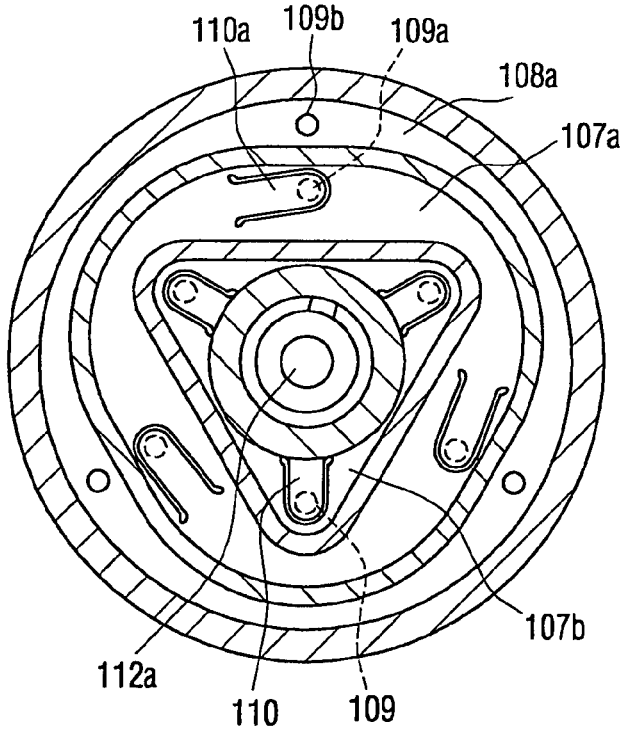
FIG. 5 is a cross sectional view of the fluid machine taken along a line V—V in FIG. 3.

FIG. 3 is a cross sectional view of the fluid machine, FIG. 4 is a cross sectional view taken along a line IV—IV in FIG. 3, and FIG. 5 is a cross sectional view taken along another line V—V in FIG. 3. The fluid machine 10 comprises a pump-motor mechanism 100 for compressing or expanding the fluid (gas-phase refrigerant in this embodiment), an electric rotating machine 200 for generating an electric power upon receiving a rotational energy or generating the rotational energy upon receiving the electric power, and an electromagnetic clutch 300 constituting a driving force transmitting device for selectively transmitting a driving force from the engine 20 (which is an outside source of the driving force) to the pump-motor mechanism 100.

The electric rotating machine 200 comprises stator 210 and a rotor 220 rotating in the stator 210. The stator 210 comprises a stator coil in which stator windings are wound on a stator core, and the rotor 220 comprises a magnet rotor to which a permanent magnet is firmly attached.

When the electric power is applied to the stator 210, the rotor 220 is rotated to operate as an electric motor for driving the pump-motor mechanism 100. On the other hand, when a rotational torque is applied to the rotor 220, the electric rotating machine 200 operates as an electric power generator.

The electromagnetic clutch 300 comprises a pulley portion 310 which is connected to the engine 20 (which corresponds to the outside source of the driving force) via V-belts, an exciting coil 320 for generating electromagnetic field, and a friction plate 330 to be displaced by electromagnetic force induced by the electromagnetic field generated by the coil 320. When the electric power is supplied to the exciting coil 320, the fluid machine 10 is operatively connected to the engine 20, while when the supply of the electric power to the exciting coil 320 is cut off, then the fluid machine 10 is disconnected from the engine 20.

The pump-motor mechanism 100 has the same structure to that of a well known swash plate type compressor having a variable capacity, which is explained below.

A swash plate 102 is formed as a generally disk shaped body, which is rotated integrally with a shaft 101 while the swash plate 102 is tilted relative to an axial direction (longitudinal direction) of the shaft 101. Multiple pistons 104 are respectively linked with the swash plate 102 at its outer periphery through each pair of shoes 103, wherein the pistons 104 are arranged to reciprocally move in the axial direction of the shaft 101.

The multiple pistons 104 (six pistons in this embodiment) are arranged around the shaft 101 and are synchronously reciprocated with a predetermined phase difference among them.

The swash plate 102 and the shoes 103 operate as a converting mechanism which converts the rotational movement of the shaft 101 into the reciprocal movement of the pistons 104 at the pump mode operation, during which the refrigerant of the low pressure from the evaporator 14 is compressed. The swash plate 102 and the shoes 103 further operate as the converting mechanism which converts the reciprocal movement of the pistons 104 into the rotational movement of the shaft 101 at the motor mode operation, during which the fluid pressure of the refrigerant of high pressure from the heating device 30 is converted into the kinetic energy to output the mechanical energy.

In this embodiment, all of the pistons 104 can perform the pump mode operation, while a part of the pistons (three pistons in this embodiment) is arranged to perform the motor mode operation in addition to the pump mode operation. Accordingly, in this embodiment, those pistons 104 which can perform both the pump and motor mode operations are referred to as change-over pistons **104*b* (also referred to as a second group of pistons), while the remaining other pistons 104 which can perform only the pump mode operation are referred to as the fixed pistons 104*a*** (also referred to as a first group of pistons).

When each piston 104 reciprocally moves in a corresponding cylinder bore 105, a volume of a corresponding working chamber V is increased or decreased. In this operation, a stroke of the piston 104 is increased when an angle (hereinafter referred to as a tilt angle θ), which is defined between the swash plate 102 and the shaft 101, is decreased, while the stroke of the piston 104 is likewise decreased when the tilt angle θ is increased. Thus, in the present embodiment, a capacity of the pump-motor mechanism 100 is varied by changing the tilt angle θ of the swash plate 102.

The capacity of the pump-motor mechanism 100 is a theoretical flow rate of fluid, which is discharged from the pump-motor mechanism 100 or is drawn into the pump-motor mechanism 100 per rotation of the shaft 101. That is, the capacity of the pump-motor mechanism 100 is a volume, which is determined based on a product of a stroke and a diameter of the piston 104.

A space (hereinafter referred to as a swash plate chamber 106), which receives the swash plate 102, is communicated with a fixed piston discharge chamber 107*a* and a fixed piston inlet chamber 108*a*, which are respectively formed at such positions corresponding to the fixed pistons (first group of pistons) 104*a*. In a passage (not shown) communicating the swash plate chamber 106 with the fixed piston discharge chamber 107*a*, a pressure regulating valve (not shown) is provided to regulate the pressure in the fixed piston discharge chamber 107*a* and to thereby introduce such regulated pressure to the swash plate chamber 106. Furthermore, the swash plate chamber 106 and the fixed piston inlet chamber 108*a* are always communicated via a fixed orifice (not shown) to generate a predetermined pressure drop.

The tilt angle θ of the swash plate 102 is set based on a balance between the pressure in the swash plate chamber 106 and a compressive reaction force generated in each corresponding working chamber V. Thus, in the present embodiment, when the tilt angle θ is reduced, i.e., when the capacity of the pump-motor mechanism 100 is increased, an opening degree of the pressure regulating valve is reduced to decrease the pressure in the swash plate chamber 106. On the other hand, when the tilt angle θ is increased, i.e., when the capacity of the pump-motor mechanism 100 is reduced, the opening degree of the pressure regulating valve is increased to increase the pressure in the swash plate chamber 106.

The fixed piston discharge chamber 107*a* is communicated at its one side with the first group of working chambers V through ha discharge passage 109*a* and at its other side with the discharge port 116. The fixed piston inlet chamber 108*a* is communicated with the first group of working chambers V through an inlet passage 109*b* and at its other side with the inlet port 117. Check valves 110*a* are respectively provided at the discharge and inlet passages 109*a* and 109*b* for preventing the refrigerant from flowing in the reversed direction.

A change-over piston discharge chamber 107 (also referred to as a high pressure chamber) is formed at such a position corresponding to the change-over pistons (the second group of pistons) 104*b*, so that the discharge chamber (the high pressure chamber) 107 is communicated at its one side with the second group of working chambers V through a discharge passage 109 and at its other side with the high-pressure port 118. A check valve 110 is provided in this discharge chamber 107 for preventing the refrigerant from flowing in the reversed direction from the discharge chamber 107 to the second group of working chambers V The check valve 110 of the present embodiment comprises a reed valve serving as a valve body, which is placed in the high pressure side. When dynamic pressure is applied to the check valve 110 from the working chamber V toward the high pressure side, the check valve 110 is opened. On the other hand, when dynamic pressure is applied to the check valve 110 from the high pressure side toward the working chamber V, the check valve 110 is closed.

A generally cylindrical valve body (rotary valve) 112 is engaged with a double-sided portion 101*a* formed at one end of the shaft 101, so that the rotary valve 112 is rotated together with the shaft 101. In the pump mode operation, the rotary valve 112 communicates the low-pressure port 119 with the second group of working chambers V, while preventing the fluid from flowing in the reversed direction from the second group of working chambers V to the low-pressure port 119 (also referred to as a low pressure chamber) And in the motor mode operation, the rotary valve 112 communicates the discharge chamber (high pressure chamber) 107 with the second group of working chambers V, while preventing the fluid from flowing in the reversed direction from the second group of working chambers V for the piston 104*b* to the discharge chamber 107. In this motor mode operation, the rotary valve 112 further communicates the low-pressure port 119 with the second group of working chambers V, while preventing the fluid from flowing in the reversed direction from the low-pressure port 119 to the second group of working chambers V.

Figure 6A:
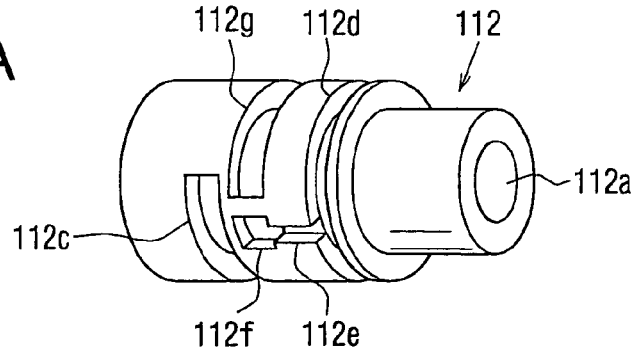
FIGS. 6A and 6B are perspective views of a rotary valve for the fluid machine shown in FIG. 3.
Figure 6B:
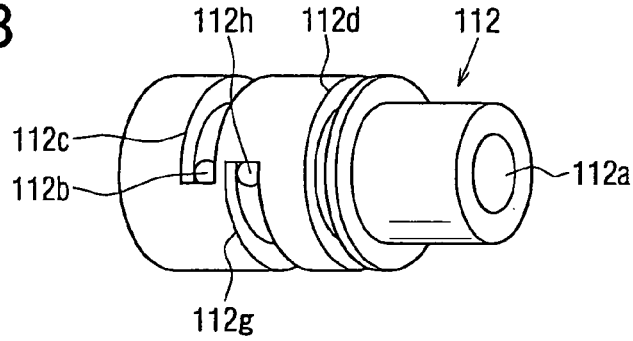

As shown in FIGS. 6A and 6B, the rotary valve 112 has a rotary valve chamber 112*a*, which is formed inside the rotary valve 112 and is always communicated with the low-pressure port 119. A first low pressure groove 112*c*, a high pressure introducing groove 112*d*, a communication groove 112*e*, a high pressure groove 112*f* and a second low pressure groove 112*g* are formed on an outer peripheral surface of the rotary valve 112.

The first low pressure groove 112*c* is formed on a side of the shaft 101 of the rotary valve 112 such that the low pressure groove 112*c* extends along a semicircular arc. The first low pressure groove 112*c* is communicated with the rotary valve chamber 112*a* through a hole 112*b*. The high pressure introducing groove 112*d* is formed along the entire outer peripheral surface of the rotary valve 112 on the other side opposite to the shaft 101. The high pressure groove 112*f* has a rectangular shape formed between the first low pressure groove 11*c* and the high pressure introducing groove 112*d* and at a position opposite to the hole 112*b* in a radial direction of the rotary valve 112. The high pressure introducing groove 112*d* and the high pressure groove 112*f* are communicated with each other through a communication groove 112*e*. A second low pressure groove 112*g* is formed between the first low pressure groove 112*c* and the high pressure introducing groove 112*d* and has a semi-circular shape. The second low pressure groove 112*g* is so arranged that the semi-circular shapes of the first and second low pressure grooves 112*c* and 112*g* are opposing to each other in a radial direction of the rotary valve 112. Another hole 112*h* is formed to communicate the second low pressure groove 112*g* with the rotary valve chamber 112*a*, wherein the other hole 112*h* is placed on the same side of the hole 112*b*, that is in the same radial direction of the rotary valve 112.

The outer periphery of the rotary valve 112 is respectively communicated with the discharge chamber (high pressure chamber) 107 through a first communicating port 121 and with the second group of working chambers V of the pistons 104*b* through a second communicating port 122. Furthermore, although the details are explained later, the rotary valve 112 can be moved in its axial direction to change its axial position with respect to the other related mechanical parts. Accordingly, with an axial position of the rotary valve 112 shown in FIG. 3, the first low pressure groove 112*c* is operatively in communication with the second communicating port 122. On the other hand, with another axial position of the rotary valve 112 shown in FIG. 7, the second low pressure groove 112*g* operatively comes in communication with the second communicating port 122.

Because of the above structure of the rotary valve 112, the communication (in FIG. 3) between the first low pressure groove 112*c* and the second communicating port 122 (the second group of working chambers V of the pistons 104*b*), the communication between the high pressure introducing groove 112*d* and the first communicating port 121 (the high pressure chamber 107), and the communication (in FIG. 7) between the second low pressure groove 112*g* and the second communicating port 122 (the second group of working chambers V of the pistons 104*b*) are changed over in accordance with the rotation of the rotary valve 112, that is the rotation of the shaft 101, and changed over synchronously with the reciprocal movement of the change-over pistons 104*b*.

Figure 7:
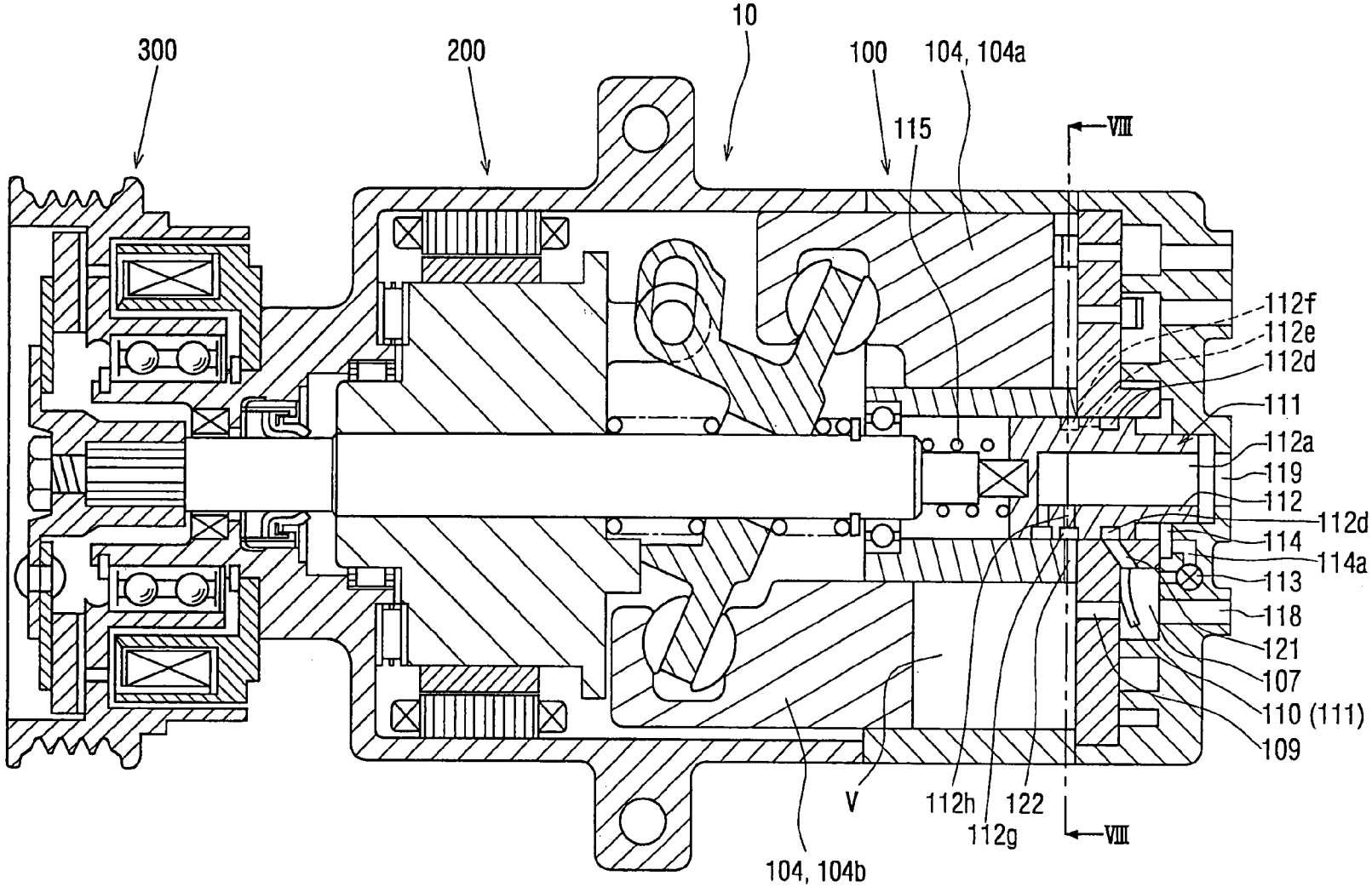
FIG. 7 is a cross sectional view of the fluid machine (the compressor device integrated with the expansion device) for the Rankine vapor compression system shown in FIG. 1, which is in the pump-motor mode operation.

A back pressure chamber 114 is formed on a side of an axial end of the rotary valve 112, as shown in FIGS. 3 and 7, which is operatively communicated with the change-over piston discharge chamber 107. An electromagnetic on-off valve 113 is provided in a passage 114*a* connecting the back pressure chamber 114 and the change-over piston discharge chamber 107, so that the high pressure is introduced to the back pressure chamber 114 from the discharge chamber 107 when the passage 114*a* is opened by the electromagnetic on-off valve 113, which is controlled by the electronic control unit (not shown)

A spring 115 is arranged at an axially opposite end of the rotary valve 112 for urging the rotary valve 112 in the direction to the back pressure chamber 114, so that the rotary valve 112 is moved in a direction parallel to the longitudinal direction of the shaft 101 and its axial position is controlled by adjusting the pressure of the fluid in the back pressure chamber 114.

An actuator for changing over between the control modes in the pump mode and motor mode operations is composed of the electromagnetic valve 113, the back pressure chamber 114 and the spring 115.

Furthermore, a valve mechanism 111 is composed of the rotary valve 112, the check valve 110, the electromagnetic valve 113, the back pressure chamber 114 and the spring.

Now, the operation of the fluid machine 10 (the compressor device integrated with the expansion device) is explained.

(1. Pump Mode Operation)

In this operation, the pistons 104 (all of the fixed pistons (first group) 104*a* and the change-over pistons (second group) 104*b*) of the pump-motor mechanism 100 are reciprocally moved by applying the rotational movement to the shaft 101, so that the refrigerant is sucked in and compressed.

More in detail, the fluid passage change-over device 35 is changed over to the position shown in FIG. 1, and the operation of the liquid pump 32 is stopped. The engine cooling water is prevented from flowing through the heating device 30 by changing over the position of the three way valve 21. Furthermore, the passage 114*a* is closed by the electromagnetic valve 113 to move the rotary valve 112 in the right hand direction as shown in FIG. 3, so that the first low pressure groove 112*c* and the second communicating port 122 operatively come in communication with each other on one hand, and the high pressure introducing groove 112*d* and the first communicating port 121 are out of communication on the other hand.

In the above operational mode, the low pressure refrigerant flows into the first group of working chambers V of the fixed piston 104*a* from the evaporator 14 through the inlet port 117, the inlet chamber 108*a* and the inlet passage 109*b*, as indicated by arrows in FIG. 1. The high pressure refrigerant compressed at the first group of working chambers V, is then discharged to the heat radiating device 11 through the discharge passage 109*a*, the discharge chamber 107*a* and the discharge port 116.

On the other hand, the low pressure refrigerant likewise flows into the second group of working chambers V of the change-over piston 104*b* from the evaporator 14 through the low-pressure port 119, the rotary valve chamber 112*a*, the hole 112*b*, the first low pressure groove 112*c*, the second communicating port 122, as indicated by the arrows in FIG. 1, when the change-over piston 104*b* is moved from its top dead center towards its bottom dead center. When the change-over piston 104*b* is moved thereafter from the bottom dead center towards the top dead center, the second communicating port 122 is closed by the outer peripheral surface of the rotary valve 112, so that the refrigerant can be compressed in the second group of working chambers V. The high pressure refrigerant thus compressed at the working chamber V will be discharged to the heat radiating device 11 through the discharge port 109, the discharge chamber 107 and the high-pressure port 118.

In the above operation, the second group of working chambers V for the change-over pistons 104*b* operatively come in communication with the rotary valve chamber 112*a* in a sequential order as the shaft 101 (and the rotary valve 112) is rotated. The low pressure refrigerant is sucked into the working chambers in the order and compressed by the respective working chambers. The capacity of the pump motor mechanism 100 can be varied by changing the tilt angle θ of the swash plate 102, depending the required amount of the compressed refrigerant.

There are two ways for applying the rotational force to the shaft 101. In one of the ways, the fluid machine 10 is connected to the engine 20 by the electromagnetic clutch 300 to apply the rotational force of the engine 20 to the fluid machine 10. In another way, the fluid machine 10 is disconnected from the engine 20 by the clutch 300 and the electric rotating machine 200 is operated as the electric motor.

In case that the rotational force from the engine 20 is applied to the fluid machine 10, the electric power is supplied to the electromagnetic clutch 300 so that the fluid machine 10 is connected with the engine 20. In this operation, the rotor 220 is rotated by the shaft 101 so that the electric rotating machine 200 is also operated as the electric power generator. The electric power generated at the electric rotating machine 200 is charged in a battery.

In the case that the rotational force is applied from the electric rotating machine 200 to the shaft 101, the supply of the electric power to the electromagnetic clutch 300 is cut off to disconnect the fluid machine 10 from the engine 20 and the electric power is supplied to the stator 210 so that the electric rotating machine 200 is operated as the electric motor to generate the rotational force to the shaft 101.

(2. Pump-Motor Mode Operation)

This operation is performed when the required amount of the compressed refrigerant is smaller than that for the above pump mode operation. In this operation, while the refrigerant is compressed by the first group of working chambers V of the fixed pistons 104*a*, the mechanical energy is obtained at the change-over pistons 104*b* by introducing the super heated refrigerant of high pressure into the second group of working chambers V of the change-over pistons 104*b* and expanding the refrigerant therein to reciprocally move the change-over pistons 104*b*.

In this operation, the mechanical energy obtained from the change-over pistons 104*b* is used to assist the operation of the fixed pistons 104*a* and to generate the electric power at the electric rotating machine 200 when the sufficient mechanical energy is obtained.

To achieve the above pump-motor mode operation, the fluid passage is changed over by the change-over device 35 from the position shown in FIG. 1 to that shown in FIG. 2, and the operation of the liquid pump 32 is started. By changing the position of the three way valve 21, the engine cooling water flows into the heating device 30. The electromagnetic valve 113 is opened to move the rotary valve 112 in the left hand direction in FIG. 7, so that second low pressure groove 112*g* and the second communicating port 122 operatively come into communication and that the high pressure introducing groove 112*d* and first communicating port 121 operatively come into communication.

In this operation, the low pressure refrigerant flows into the first group of working chambers V of the fixed pistons 104*a* in the same manner to the pump mode operation, namely the low pressure refrigerant from the evaporator 14 is compressed at the working chambers V and discharged to the heat radiating device 11, as indicated by black arrows in FIG. 2.

On the other hand, the super heated refrigerant is introduced into the second group of working chambers V of the change-over pistons 104*b* from the heating device 30 through the fluid passage change-over device 35, the high-pressure port 118, the discharge chamber 107, the first communicating port 121, the high pressure introducing groove 112*d*, the communication groove 112*e*, the high pressure groove 112*f* and the second communicating port 122, when the change-over pistons 104*b* is moved from its top dead center towards its bottom dead center, as indicated by white arrows in FIG. 2. When the rotary valve 112 is rotated further, the second communicating port 122 is closed by the outer peripheral surface of the rotary valve 122, and the high pressure super heated refrigerant is expanded in the second group of working chambers V by pushing back the change-over pistons 104*b* to the bottom dead center, to thereby rotate the shaft 101. During the change-over piston 104*b* is moved from the bottom dead center to the top dead center, the second communicating port 122 is operatively in communication with the second low pressure groove 112*g*, so that the low pressure refrigerant after expansion flows into the rotary valve chamber 112*a* through the hole 112*h* formed at the second low pressure groove 112*g* and finally discharged to the heat radiating device 11 through the low-pressure port 119, as indicated by white arrows in FIG. 2.

In this operation, the check valve 110 is kept closed by the high pressure super heated refrigerant introduced into the discharge chamber 107, so that the refrigerant is prevented from flowing in the reversed direction from the second group of working chambers V to the discharge chamber 107.

Figure 8:
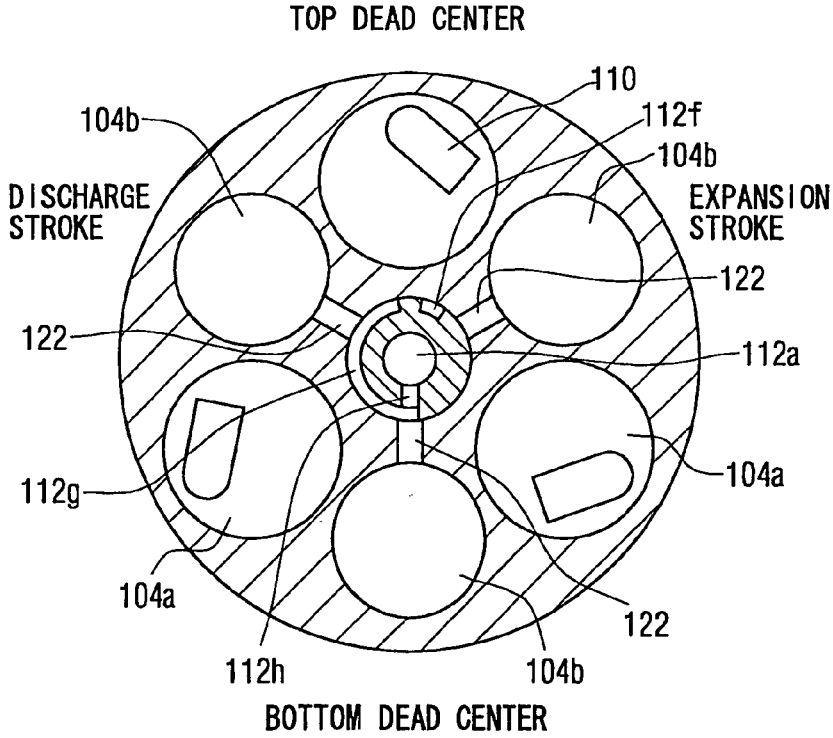
FIG. 8 is a cross sectional view of the fluid machine taken along a line VIII—VIII in FIG. 7.

In the above operation, the second group of working chambers V for the change-over pistons 104*b* operatively come in communication with the high pressure groove 112*f* and thereby with the discharge chamber 107, in a sequential order as the shaft 101 (and the rotary valve 112) is rotated, as shown in FIG. 8. Accordingly, the high pressure super heated refrigerant is introduced into the second group of working chambers in the order and expanded therein.

As above, the volume of the working chamber V is increased by the expansion of the refrigerant to move the pistons 104*b*, to thereby rotate the shaft 101. At the same time, the second group of working chambers V come operatively and respectively into communication with the high pressure groove 112*f* and with the second low pressure groove 112*g* in the sequential order as the rotation of the shaft 101, so that the high pressure super heated refrigerant can be continuously expanded in the respective working chambers V.

As understood from the above embodiment, the pump mode operation and the motor mode operation can be performed at the same time in the fluid machine 10, without separately providing the compressor device and the expansion device.

As the mechanical energy obtained from the change-over pistons 104*b* during the pump-motor mode operation can be used to assist the operation for the fixed pistons 104*a*, the load to the engine 20 can be reduced. Furthermore, the mechanical energy thus obtained can be used to generate the electric power at the electric rotating machine 200 and such electric power is charged into the battery, the load to the engine can be further reduced.

The valve mechanism 111 of the simple structure is obtained by the rotary valve 112 connected to the shaft 101, the check valve 110, the electromagnetic valve 113, the back pressure chamber 114 and the spring 115, wherein the valve mechanism 111 operates in synchronized manner with the reciprocal movements of the pistons 104. In this valve mechanism 111, the high pressure super heated refrigerant from the heating device 30 is prevented from flowing in the reversed direction, so that the pump-motor mode operation is realized in addition to the pump mode operation.

Second Embodiment

The second embodiment of the present invention is explained with reference to FIGS. 9 to 12. In the second embodiment, the motor mode operation can be performed in all of the pistons 104, in addition to the pump mode operation and the pump-motor mode operation which are performed in the first embodiment.

The fluid machine 10 comprises, as in the first embodiment, a pump-motor mechanism 100 having a swash plate, a first group of (three) pistons 104*a* and a second group of (three) pistons 104*b*. The fluid machine 10 further comprises a first discharge chamber 107*d*, a second discharge chamber 107*c*, and a first inlet chamber 108*c*, which are provided on a side of the respective pistons 104 opposite to the swash plate. A discharge space 107*e* (a low pressure chamber) and an inlet space 108*d* (a high pressure chamber) are formed at an end of the shaft 101.

The first group of working chambers V for the first group of pistons 104*a* are respectively communicated with the first discharge chamber 107*d* and the first inlet chamber 108*c*, and check valves 110*a* are respectively provided in communication passages between the first group of working chambers V and the discharge chamber 107*d* as well as between the first group of working chambers V and the inlet chamber 108*c*.

As in the same manner, the first group of working chambers V for the first group of pistons 104*b* are respectively communicated with the second discharge chamber 107*c* and the first inlet chamber 108*c*, and check valves 110 are respectively provided in communication passages between the working chambers V and the discharge chamber 107*c*.

Figure 9:
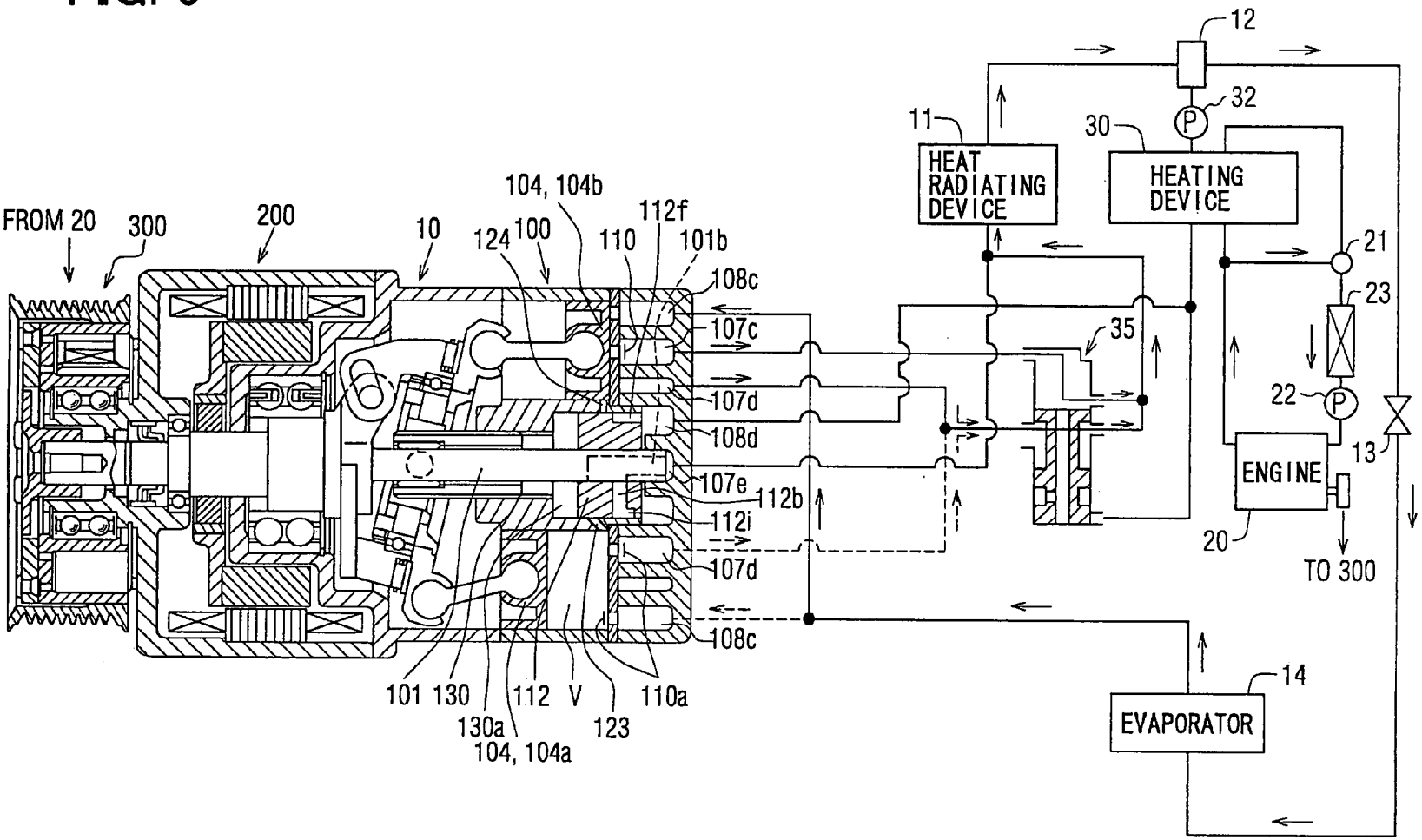
FIG. 9 is a schematic diagram showing a Rankine vapor compression refrigerating system according to a second embodiment of the present invention, wherein a flow of refrigerant is indicated in a pump mode operation.
Figure 10:
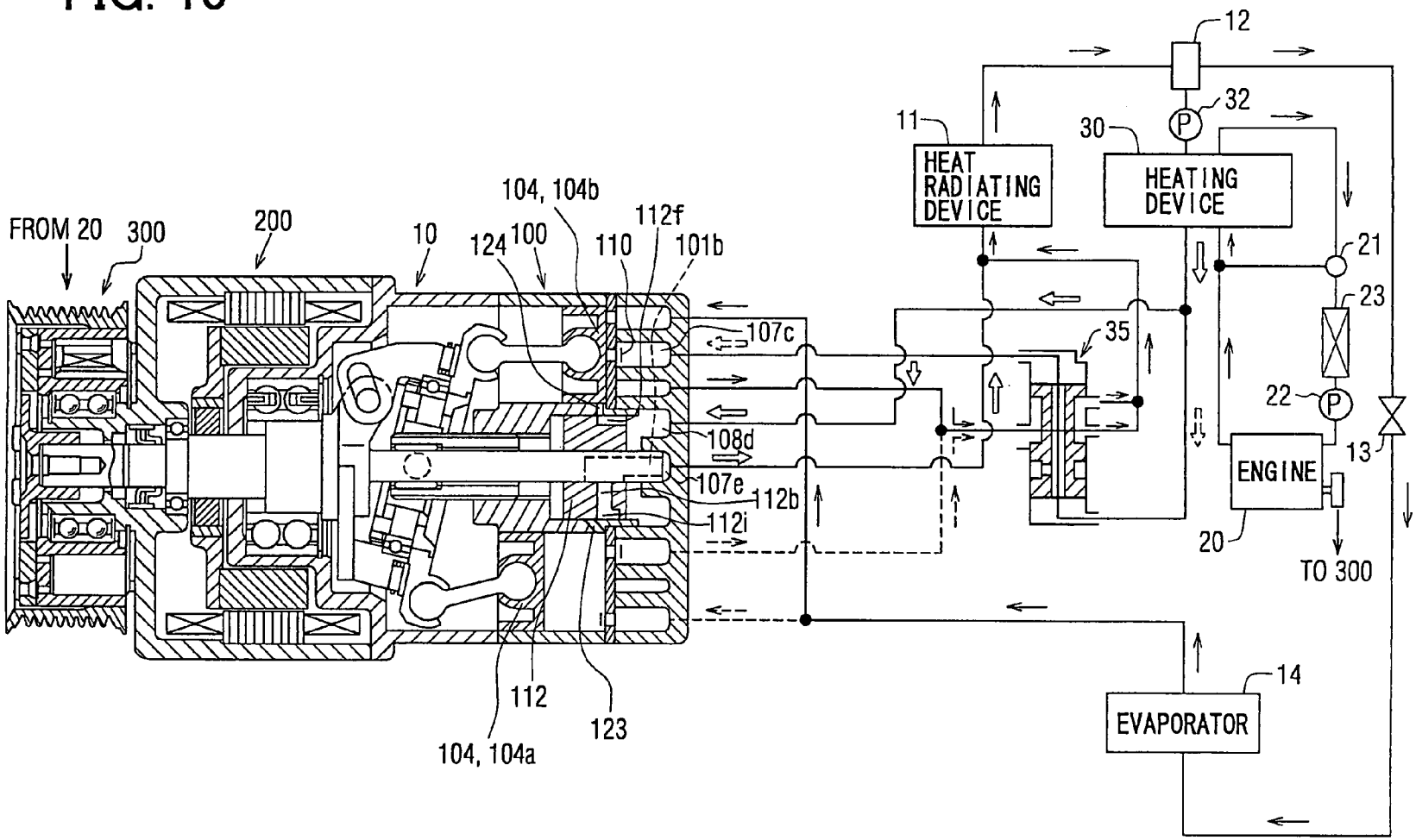
FIG. 10 is a schematic diagram of the Rankine vapor compression refrigerating system shown in FIG. 9, wherein a flow of the refrigerant is indicated in a pump-motor mode operation.
Figure 11:
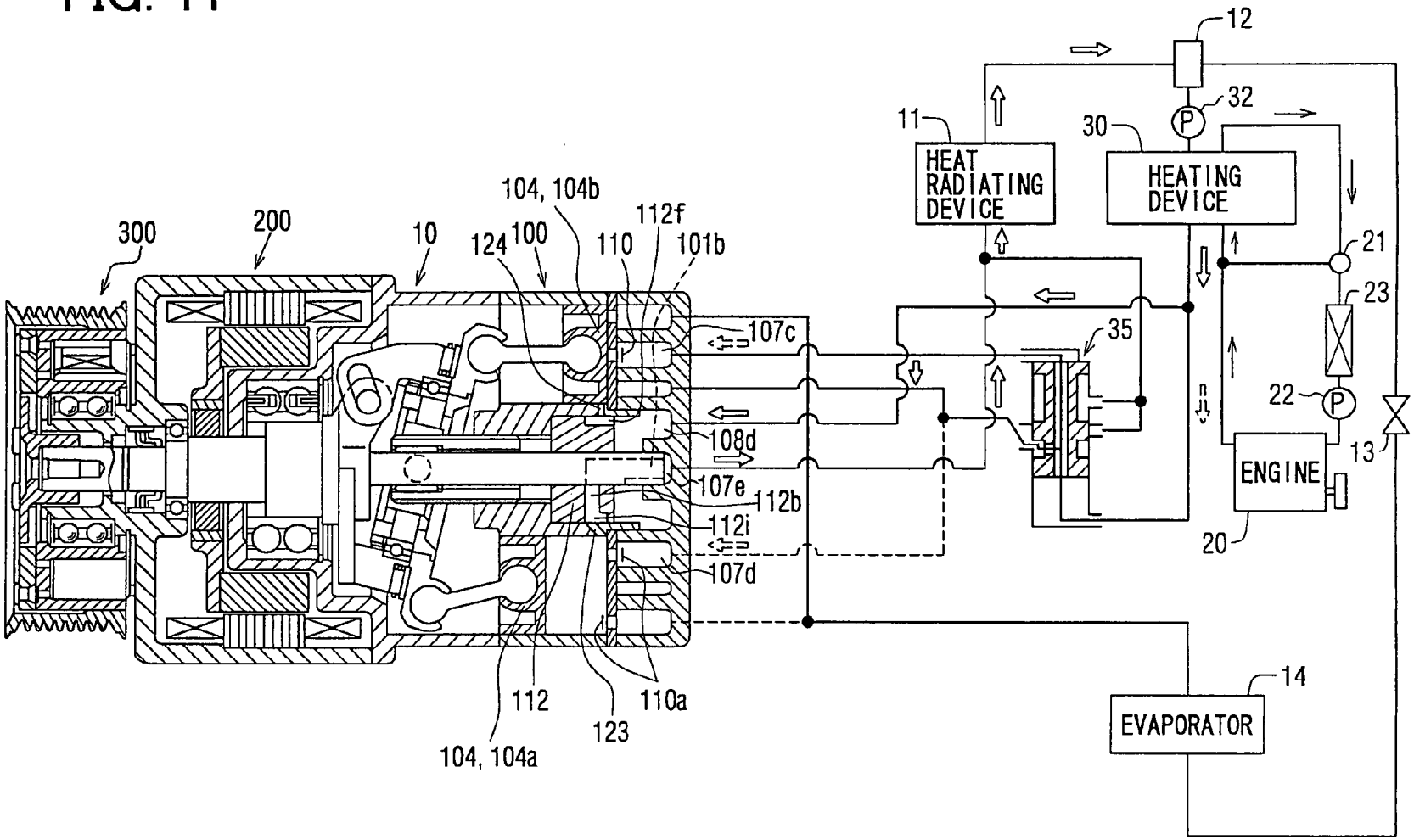
FIG. 11 is a schematic diagram of the Rankine vapor compression refrigerating system shown in FIG. 9, wherein a flow of the refrigerant is indicated in a motor mode operation.
Figure 12A:
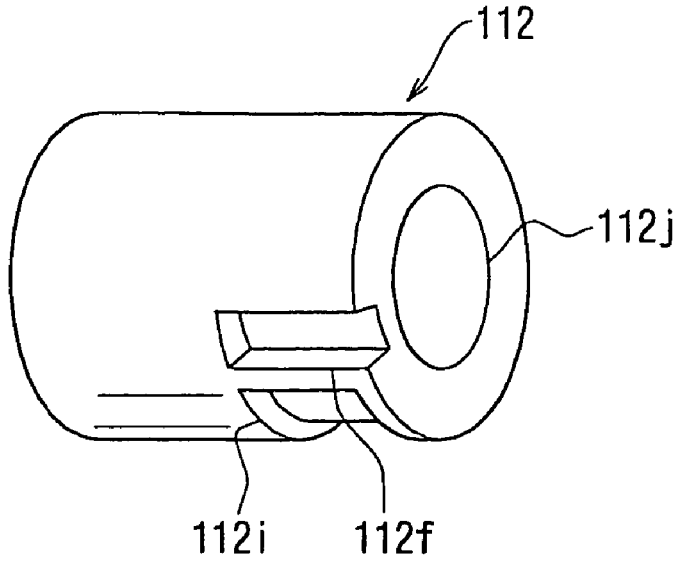
FIGS. 12A and 12B are perspective views of a rotary valve for the fluid machine shown in FIG. 9.
Figure 12B:
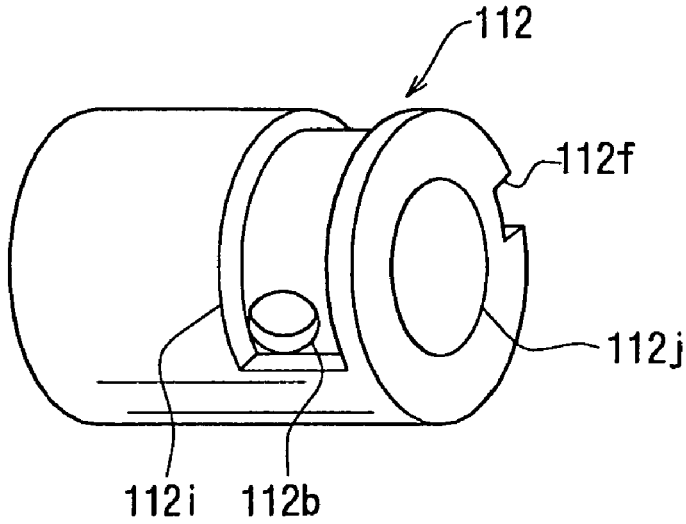

A rotary valve 112 shown in FIGS. 12A and 12B is provided on one end of the shaft 101. The rotary valve 112 has a through-hole 112*j* at its center into which the end of the shaft 101 is inserted, so that the rotary valve 112 is rotated together with the shaft 101. The rotary valve 112 is movable in a longitudinal (axial) direction of the shaft 101 and the relative position of the rotary valve 112 to the shaft 101 in the longitudinal direction is controlled by an actuator (not shown) among three positions, which are shown in FIGS. 9 to 11. Namely, those are the right hand position in FIG. 9, the intermediate position in FIG. 10 and the left hand position in FIG. 11.

A high pressure groove 112*f* is formed on an outer periphery of the rotary valve 112, which extends in the longitudinal direction from an end on a side of the inlet space 108*d*. A low pressure groove 112*i* is also formed on the outer periphery, which has a semi-circular form and one end of the semi-circular groove 112*i* is positioned at a point close to the high pressure groove 112*f*, as shown in FIG. 12A. A hole 112*b* is further formed in the rotary valve 112 at a position opposite to the high pressure groove 112*f*, wherein the hole 112*b* communicates the low pressure groove 112*i* with the through-hole 112*j*.

The rotary valve 112 is movably held in a cylindrical bore 130*a* of a housing portion 130. A pair of communicating ports 123 and 124 are formed in the housing portion 130, which respectively open at one ends to the cylindrical bore 130*a* and at the other ends to the working chambers V.

An L-shaped communicating hole 101*b* is formed at the end of the shaft 101, one end of which is communicated with the discharge space 107*e* and the other end of which opens to the inner peripheral surface of the through-hole 112*j* of the rotary valve 112.

The fluid machine 10 is operatively connected to the heat radiating device 11, the evaporator 14 and the heating device 30 via the fluid passage change-over device 35. The change-over device 35 has three different control positions, so that the fluid passages are changed over depending on the respective operational modes, as will be explained with reference to FIGS. 9 to 11.

A downstream side of the evaporator 14 is connected to the first inlet chamber 108*c* of the fluid machine 10 (including dotted lines), and the second discharge chamber 107*c* and the first discharge chamber 107*d* are operatively connected to the heat radiating device 11 via the fluid passage change-over device 35 (also including dotted lines). The discharge space 107*e* is connected to the heat radiating device 11. A downstream side of the heating device 30 is connected to the inlet space 108*d* and a fluid passage branching off from the heating device 30 is connected to the fluid passage change-over device 35.

An operation of the system according to the second embodiment will be explained.

(1. Pump Mode Operation)

In this operation, as in the first embodiment, the refrigerant is compressed by the working chambers V, wherein all of the pistons 104 (the first group of pistons 104*a* and the second group of pistons 104*b*) of the pump-motor mechanism 100 are reciprocated by the rotation of the shaft 101.

More in detail, the fluid passage change-over device 35 is changed over to the position shown in FIG. 9, and the operation of the liquid pump 32 is stopped. The engine cooling water is prevented from flowing through the heating device 30 by changing over the position of the three way valve 21. Furthermore, the rotary valve 112 is moved by the actuator (not shown) to the right hand position as shown in FIG. 9, so that both inner ends of the communicating ports 123 and 124 are closed by the outer peripheral surface of the rotary valve 122.

With the position of the rotary valve 112 as above, the refrigerant of low pressure is sucked into the first group of working chambers V for the pistons 104*a* from the evaporator 14 through the first inlet chamber 108*c*, and the high pressure refrigerant compressed at the working chambers V is discharged to the heat radiating device 11 through the first discharge chamber 107*d* and the fluid passage change-over device 35.

In the same manner, the refrigerant of low pressure is sucked into the second group of working chambers V for the pistons 104*b* from the evaporator 14 through the first inlet chamber 108*c*, and the high pressure refrigerant compressed at the working chambers V is discharged to the heat radiating device 11 through the second discharge chamber 107*c* and the fluid passage change-over device 35. The capacity of the pump-motor mechanism 100 can be varied by changing the tilt angle θ of the swash plate 102, depending the required amount of the compressed refrigerant.

There are two ways for applying the rotational force to the shaft 101, as in the first embodiment. In one of the ways, the fluid machine 10 is connected to the engine 20 by the electromagnetic clutch 300 to apply the rotational force of the engine 20 to the fluid machine 10. In the other way, the fluid machine 10 is disconnected from the engine 20 by the clutch 300 and the electric rotating machine 200 is operated as the electric motor.

(2. Pump-Motor Mode Operation)

This operation is performed when the required amount of the compressed refrigerant is smaller than that for the above pump mode operation. In this operation, as in the same manner of the first embodiment, while the refrigerant is compressed by the first group of working chambers V of the first group of pistons 104*a*, the mechanical energy is obtained at the second group of pistons 104*b* by introducing the super heated refrigerant of high pressure into the second group of working chambers V of the pistons 104*b* and expanding the refrigerant therein to reciprocally move the second group of pistons 104*b*.

In this operation, the mechanical energy thus obtained is used to assist the operation of the first group of pistons 104*a* and to generate the electric power at the electric rotating machine 200 when the sufficient mechanical energy is obtained. The electric power generated as above is charged into the battery.

To achieve the above pump-motor mode operation, the fluid passage is changed over by the change-over device 35 from the position shown in FIG. 9 to that shown in FIG. 10, and the operation of the liquid pump 32 is started. By changing the position of the three way valve 21, the engine cooling water flows into the heating device 30. The rotary valve 112 is moved in the left hand direction by the actuator (not shown), so that the rotary valve 112 is positioned at its intermediate position shown in FIG. 10. With the position of the rotary valve 112 in FIG. 10, the high pressure groove 112*f* and the communicating port 124 operatively come into communication, while the other communicating port 123 is held as closed.

In this operation, the low pressure refrigerant flows into the first group of working chambers V of the pistons 104*a* in the same manner to the pump mode operation, namely the low pressure refrigerant from the evaporator 14 is compressed at the first group of working chambers V and discharged to the heat radiating device 11, as indicated by black arrows of the dotted lines in FIG. 10.

On the other hand, the super heated refrigerant of high pressure is introduced into the second group of working chambers V of the pistons 104*b* from the heating device 30 through the inlet space 108*d*, high pressure groove 112*f* and the communicating port 124, when the second group of pistons 104*b* is moved from its top dead center towards its bottom dead center, as indicated by white arrows in FIG. 10. When the rotary valve 112 is rotated further, the communicating port 124 is closed by the outer peripheral surface of the rotary valve 122, and the high pressure super heated refrigerant is expanded in the working chambers V by pushing back the second group of pistons 104*b* to the bottom dead center, to thereby rotate the shaft 101. During the second group of piston 104*b* is moved from the bottom dead center to the top dead center, the communicating port 124 is in communication with the low pressure groove 112*i*, so that the low pressure refrigerant after expansion flows into the L-shaped hole 101*b* of the shaft 101 through the hole 112*b* and finally discharged to the heat radiating device 11 through the discharge space 107*e*, as indicated by white arrows in FIG. 10.

In this operation, the check valve 110 is kept closed by the high pressure super heated refrigerant introduced into the second discharge chamber 107*c*, so that the refrigerant is prevented from flowing in the reversed direction from the second group of working chambers V to the second discharge chamber 107*c*.

As above, the volume of the working chamber V is increased by the expansion of the super heated refrigerant to move the pistons 104*b*, to thereby rotate the shaft 101. At the same time, the working chambers V respectively and operatively come into communication with the communicating port 124 and the high pressure groove 112*f* and with the communicating port 124 and the low pressure groove 112*i* in the sequential order as the rotation of the shaft 101, so that the high pressure super heated refrigerant can be continuously expanded in the respective working chambers V.

(3. Motor Mode Operation)

This motor mode operation is an additional operation, when compared with the first embodiment. When the compression of the refrigerant is not necessary, the super heated refrigerant of the high pressure heated by the heating device 30 is introduced into all of the working chambers V for the first and second groups of pistons 104*a* and 104*b*, and the refrigerant is expanded in the respective working chambers to perform the reciprocal movement of the pistons 104, to finally obtain the mechanical energy for rotating the shaft 101.

In this operation, the electric rotating machine 200 is rotated by the mechanical energy obtained above, to generate the electric power which is then charged into the battery.

To achieve the above motor mode operation, the fluid passage is changed over by the change-over device 35 from the position shown in FIG. 9 or FIG. 10 to that shown in FIG. 11, and the operation of the liquid pump 32 is started. By changing the position of the three way valve 21, the engine cooling water flows into the heating device 30. The rotary valve 112 is moved in the left hand direction by the actuator (not shown), so that the rotary valve 112 is positioned at its left hand position shown in FIG. 11. With the position of the rotary valve 112 in FIG. 11, the high pressure groove 112*f* and the low pressure groove 112*i* operatively come into communication respectively with the communicating ports 123 and 124.

With the above position of the rotary valve 112, the second group of working chambers V for the pistons 104*b* performs the same operation to that in the pump-motor mode operation. Namely, the super heated refrigerant of high pressure is introduced into the second group of working chambers V of the pistons 104*b* from the heating device 30 through the inlet space 108*d*, the refrigerant is expanded in the working chambers V to move the second group of pistons 104*b* to the bottom dead center, and the shaft 101 is thereby rotated. Then the low pressure refrigerant after expansion is discharged to the heat radiating device 11 through the discharge space 107*e*, as indicated by white arrows in FIG. 11.

On the other hand, the super heated refrigerant of high pressure is introduced into the first group of working chambers V of the pistons 104*a* from the heating device 30 through the inlet space 108*d*, the high pressure groove 112*f* and the communicating port 123, when the first group of pistons 104*b* is moved from its top dead center towards its bottom dead center, as indicated by white arrows in FIG. 11. When the rotary valve 112 is rotated further, the communicating port 123 is closed by the outer peripheral surface of the rotary valve 122, and the high pressure super heated refrigerant is expanded in the working chambers V by pushing back the first group of pistons 104*a* to the bottom dead center, to thereby rotate the shaft 101. During the first group of piston 104*a* is moved from the bottom dead center to the top dead center, the communicating port 123 is in communication with the low pressure groove 112*i*, so that the low pressure refrigerant after expansion flows into the L-shaped hole 101*b* of the shaft 101 through the hole 112*b* and finally discharged to the heat radiating device 11 through the discharge space 107*e*, as indicated by white arrows in FIG. 11.

In this operation, the check valve 110*a* is kept closed by the high pressure super heated refrigerant introduced into the first discharge chamber 107*d*, as indicated by the white arrow of the dotted line, so that the refrigerant is prevented from flowing in the reversed direction from the first group of working chambers V to the first discharge chamber 107*d*.

As above, the volume of the working chamber V is increased by the expansion of the super heated refrigerant to move all of the pistons 104, to thereby rotate the shaft 101. At the same time, the working chambers V operatively and respectively come into communication with the communicating port 124 and the high pressure groove 112*f* and with the communicating port 123 and the low pressure groove 112*i* in the sequential order as the rotation of the shaft 101, so that the high pressure super heated refrigerant can be continuously expanded in all of the working chambers V.

In the case that the amount of the waste heat from the engine 20 is small, namely the amount of the super heated refrigerant is small, during the above motor mode operation, the number of revolution for the shaft 101, i.e. the number of revolution of the rotor 220 is decreased, to thereby decrease the amount of generated electric power (power generation efficiency). In such case, the capacity of the pump-motor mechanism 100 is made smaller by the swash plate 102, to increase the rotational speed of the rotor 220 to keep the electric power generation at a constant level.

On the other hand, when the amount of the super heated refrigerant is excessively large, the capacity of the pump-motor mechanism 100 is increased by the swash plate 102 to decrease the rotational speed of the rotor 220 so that the electric power generation at the constant level can be obtained.

According to the second embodiment, the motor mode operation alone can be performed in the case that the pump mode operation is not necessary, in addition to the operational modes of the first embodiment. As a result, the mechanical energy can be obtained at the most by this motor mode operation.

Other Embodiments

In the above embodiments, the pistons are arranged on one side of the swash plate. However, the pump-motor mechanism having pistons on both sides of the swash plate can be also used in the present invention.

The electromagnetic clutch 300 is used in the above embodiments for selectively transmitting the driving force from the engine to the fluid machine. The clutch 300 can be, however, replaced by any other devices, such as one-way clutch.

The energy obtained by the fluid machine 10, namely the electric power, is charged into the battery. However, the energy obtained by the fluid machine can be charged or held as other energies than the electric power, for example, as kinetic energy by a flywheel, or as elastic potential energy by a spring.

The fluid machine is used, in the above embodiments, in the gas compression refrigerating system having the Rankine cycle for the motor vehicle. The fluid machine can be used for any other systems and/or purposes.

The valve mechanism 111 is composed of the mechanical components, as explained in the above embodiments. However, such valve mechanism can be also used in this invention, in which various valves are controlled by not mechanically but electrically.

What is claimed is:

1. A gas compression refrigerating system comprising:

a fluid machine for performing a pump mode operation for compressing working fluid and a motor mode operation for generating mechanical energy by converting fluid pressure into kinetic energy; and a fluid passage change-over device operatively connected to the fluid machine for selectively allowing the working fluid to and/or from the fluid machine through the fluid passage change-over device, depending on operational modes at the fluid machine, wherein the fluid machine comprises:

multiple working chambers, each having a piston movable in a reciprocal manner so that the volume of the working chamber can be increased and/or decreased by the reciprocal movement of the piston, the multiple working chambers being composed of a first working chamber and a second working chamber;

a first and a second pump mode passages for allowing the working fluid from an inlet side to an output side of the fluid machine through the first and second working chambers to perform the pump mode operations at the respective working chambers, when the working fluid of low pressure is supplied to the inlet side and the pistons of the first and second working chambers are driven to move in the reciprocal manner;

a high pressure chamber and a low pressure chamber to be respectively communicated with the second working chamber; and a valve mechanism selectively forming a motor mode passage connecting the high pressure chamber and the low pressure chamber at least through the second working chamber, wherein the fluid passage change-over device and the valve mechanism change-over the fluid passage for the second working chamber from the second pump mode passage to the motor mode passage, so that the second working chamber performs the motor mode operation when the super heated working fluid of high pressure is introduced into the second working chamber, and the valve mechanism prevents the working fluid from flowing in the reversed direction in the motor mode operation.

2. A gas compression refrigerating system according to claim 1, wherein the valve mechanism further selectively forms another motor mode passage connecting the high pressure chamber and the low pressure chamber through the first working chamber, wherein the fluid passage change-over device and the valve mechanism change-over the fluid passage for the first working chamber from the first pump mode passage to the other motor mode passage, so that the first working chamber performs the motor mode operation when the super heated working fluid of high pressure is introduced into the first working chamber, and the valve mechanism prevents the working fluid from flowing in the reversed direction in the motor mode operation for the first working chamber.

3. A gas compression refrigerating system according to claim 1 or 2, wherein the valve mechanism includes a valve member which is synchronously operated with at least the reciprocal movement of the piston for the second working chamber.

4. A gas compression refrigerating system according to claim 1 or 2, wherein the fluid machine further comprises:

a shaft rotationally supported by a housing of the fluid machine; and a converting mechanism operatively connected between the shaft and the pistons for converting a rotational movement of the shaft to the reciprocal movement of the pistons, and vice versa.

5. A gas compression refrigerating system according to claim 4, wherein the valve mechanism includes a valve member which is synchronously operated with at least the reciprocal movement of the piston for the second working chamber, and the valve member controls the communication between the low pressure chamber and the second working chamber during the pump mode operation, and further controls the communication between the low pressure chamber and the second working chamber as well as the communication between the high pressure chamber and the second working chamber during the motor mode operation.

6. A gas compression refrigerating system according to claim 1, wherein the valve mechanism includes a valve member which is synchronously operated with at least the reciprocal movement of the piston for the second working chamber, and the fluid machine further comprises:

a shaft rotationally supported by a housing of the fluid machine; and an actuator for moving the valve member in an axial direction of the shaft to close the second pump mode passage and to open the motor mode passage, when the second working chamber will be operated in the motor mode operation.

7. A gas compression refrigerating system according to claim 3, wherein the valve mechanism further includes a check valve for preventing the working fluid from flowing in the reversed direction from the high pressure chamber to the second working chamber.

8. A gas compression refrigerating system according to claim 1, wherein the fluid machine further comprises:

an electric rotating machine rotationally supported in the housing of the fluid machine, a rotor of which is connected to the shaft.

9. A gas compression refrigerating system according to claim 1, wherein the fluid machine further comprises:

a power transmitting device for selectively transmitting a driving force from an outside source of the driving source to the shaft.

10. A gas compression refrigerating system according to claim 9, wherein the power transmitting device comprises an electromagnetic clutch for selectively transmitting the driving force to the shaft.

11. A gas compression refrigerating system according to claim 10, wherein the first and second pistons of the first and second working chambers are driven by the driving force from at least one of the outside source of the driving force and the electric rotating machine for performing the pump mode operation, and mechanical energy generated by the second working chamber during performing the motor mode operation is used to assist the operation of the first working chamber which is performing the pump mode operation.

12. A gas compression refrigerating system comprising:

a fluid machine for performing a pump mode operation for compressing working fluid and a motor mode operation for generating mechanical energy by converting fluid pressure into kinetic energy; and a fluid passage change-over device operatively connected to the fluid machine for selectively allowing the working fluid to and/or from the fluid machine through the fluid passage change-over device, depending on operational modes at the fluid machine, wherein the fluid machine comprises:

multiple working chambers, each having a piston movable in a reciprocal manner so that the volume of the working chamber can be increased and/or decreased by the reciprocal movement of the piston, the multiple working chambers being composed of a first working chamber and a second working chamber;

an inlet chamber and a discharge chamber to be respectively communicated with the first working chamber for forming a first pump mode passage;

a check valve provided in the first pump mode passage, so that the working fluid flows from the inlet chamber to the discharge chamber through the first working chamber, and thereby the first working chamber performs the pump mode operation when working fluid of low pressure is supplied to the inlet chamber and the piston of the first working chamber is driven to move in the reciprocal manner;

a high pressure chamber and a low pressure chamber to be respectively communicated with the second working chamber;

a valve mechanism selectively forming a second pump mode passage connecting the low pressure chamber with the high pressure chamber through the second working chamber, so that the second working chamber performs the pump mode operation when working fluid of low pressure is supplied to the low pressure chamber and the piston of the second working chamber is driven to move in the reciprocal manner, and the valve mechanism also selectively forming a motor mode passage connecting the high pressure chamber with the low pressure chamber through the second working chamber, so that the second working chamber performs the motor mode operation when the super heated working fluid of high pressure is introduced into the high pressure chamber, wherein the valve mechanism prevents the working fluid from flowing in the reversed direction in the respective pump mode and motor mode operations.

13. A gas compression refrigerating system comprising:

a fluid machine for performing a pump mode operation for compressing working fluid and a motor mode operation for generating mechanical energy by converting fluid pressure into kinetic energy; and a fluid passage change-over device operatively connected to the fluid machine for selectively allowing the working fluid to flow to and/or from the fluid machine through the fluid passage change-over device, wherein the fluid machine comprises:

multiple working chambers, each having a piston movable in a reciprocal manner so that the volume of the working chamber can be increased and/or decreased by the reciprocal movement of the piston, the multiple working chambers being composed of a first working chamber and a second working chamber;

an inlet chamber and a first discharge chamber to be operatively communicated with the first working chamber for forming a first pump mode passage from the inlet chamber to the first discharge chamber through the first working chamber;

a second discharge chamber to be operatively communicated with the second working chamber for forming a second pump mode passage from the inlet chamber to the second discharge chamber through the second working chamber;

check valves respectively provided in the first and second pump mode passages, so that the working fluid flows from the inlet chamber to the first and second discharge chambers through the first and second working chambers, and thereby the first and second working chambers perform the pump mode operation when the working fluid of low pressure is supplied to the inlet chamber and the pistons of the first and second working chambers are driven to move in the reciprocal manner;

a high pressure chamber and a low pressure chamber to be respectively and selectively communicated with the first and second working chambers; and a valve mechanism selectively forming a first and second motor mode passages respectively connecting the high pressure chamber with the low pressure chamber through the first and second working chambers, so that the second working chambers perform the motor mode operation when the super heated working fluid of high pressure is introduced into the high pressure chamber, wherein the valve mechanism closes the first and second pump mode passages during the motor mode operations are performed at the first and second motor mode passages, and prevents the working fluid from flowing in the reversed direction in the motor mode operations, and the valve mechanism also selectively forming the second motor mode passage connecting the high pressure chamber with the low pressure chamber through the second working chamber, so that the second working chamber performs the motor mode operation when the super heated working fluid of high pressure is introduced into the high pressure chamber, while the first working chamber performs the pump mode operation, wherein the valve mechanism closes the second pump mode passage during the motor mode operation is operated at the second working chamber and prevents the working fluid from flowing in the reversed direction in the motor mode operation.

* * * * *